US006561368B1

(12) United States Patent
Sturm, Jr. et al.

(10) Patent No.: US 6,561,368 B1
(45) Date of Patent: May 13, 2003

(54) TELESCOPING TUBE ASSEMBLY WITH A CABLING SYSTEM

(75) Inventors: Albert J. Sturm, Jr., Stillwater, MN (US); Mark W. Benoit, Cedar, MN (US)

(73) Assignee: PaR Systems, Inc., Shoreview, MN (US)

( * ) Notice: Subject to any disclaimer, the term of this patent is extended or adjusted under 35 U.S.C. 154(b) by 0 days.

(21) Appl. No.: 09/562,831

(22) Filed: May 1, 2000

(51) Int. Cl.[7] ..... B66C 23/00

(52) U.S. Cl. ..... 212/319; 212/333; 212/348

(58) Field of Search ..... 212/319, 333, 212/334, 348; 414/918; 187/413; 52/118

(56) References Cited

U.S. PATENT DOCUMENTS

| | | | | |
|---|---|---|---|---|
| 1,518,881 | A | 12/1924 | Walker et al. | |
| 1,711,356 | A | 4/1929 | Lewis et al. | |
| 2,503,018 | A | 4/1950 | Wittman | 242/47.5 |
| 2,600,574 | A | 6/1952 | Rayburn | 271/2.1 |
| 2,892,535 | A | 6/1959 | Cullen et al. | 203/305 |
| 3,157,376 | A | 11/1964 | Merker et al. | 248/49 |
| 3,214,033 | A | 10/1965 | Nilsson | 212/55 |
| 3,247,978 | A | 4/1966 | Neumeier | 214/1 |
| 3,291,921 | A | 12/1966 | Waninger | 191/12 |
| 3,481,490 | A | 12/1969 | Eiler | 212/55 |
| 3,580,451 | A | 5/1971 | Tengling | 226/173 |
| 3,690,534 | A | 9/1972 | Biron | 226/172 |
| 3,708,937 | A | 1/1973 | Sterner | 52/118 |
| 3,736,710 | A | 6/1973 | Sterner | 52/115 |
| 3,837,502 | A | 9/1974 | Hornagold | 212/55 |
| 3,840,128 | A | 10/1974 | Swoboda, Jr. et al. | 214/1 |
| 3,985,234 | A | 10/1976 | Jouffray | 212/144 |
| 4,004,695 | A | 1/1977 | Hockensmith et al. | 212/144 |
| 4,016,688 | A | 4/1977 | Tiffin et al. | 52/118 |
| 4,114,043 | A | 9/1978 | Gansfried | 250/445 T |
| 4,171,597 | A | 10/1979 | Lester et al. | 52/118 |
| 4,316,309 | A | 2/1982 | Richter | 26/93 |
| 4,327,533 | A | 5/1982 | Sterner | 52/115 |
| 4,459,786 | A | 7/1984 | Pitman et al. | 52/115 |
| 4,534,006 | A | 8/1985 | Minucciani et al. | 364/510 |
| 4,547,119 | A | 10/1985 | Chance et al. | 414/735 |
| 4,600,817 | A | 7/1986 | Hackenberg | 191/12 C |
| 4,782,713 | A | 11/1988 | Torii et al. | 74/89.15 |
| 4,789,120 | A | 12/1988 | Spidel | 248/49 |
| 4,957,207 | A | 9/1990 | Thomas | 212/192 |
| 5,117,859 | A | 6/1992 | Carlson | 137/355.25 |
| 5,314,083 | A | 5/1994 | Wiggershaus et al. | 212/213 |
| 5,326,010 | A | 7/1994 | Moras | 226/172 |
| 5,465,854 | A | 11/1995 | Strum, Jr. et al. | 212/319 |
| 6,026,970 | A | 2/2000 | Strum, Jr. et al. | 212/348 |
| 6,202,831 | B1 | 3/2001 | Manthei | 198/602 |

FOREIGN PATENT DOCUMENTS

GB 2 179 022 A 2/1987

OTHER PUBLICATIONS

"Striving For Excellence in Remote Positioning, Materials handling and Robotic Production", PAR Systems Application Literature, 1998.

*Primary Examiner*—Thomas J. Brahan
(74) *Attorney, Agent, or Firm*—Westman, Champlin & Kelly, P.A.; S. Koehler

(57) ABSTRACT

A telescoping tube assembly includes a frame and a first longitudinal tube section mounted on the frame. A second longitudinal tube section is disposed within the first longitudinal tube section and adapted for telescoping motion into and out of the first longitudinal tube section. The telescoping tube assembly includes a cabling system that includes a top pulley assembly and a bottom pulley assembly, the bottom pulley assembly adapted for movement in response to the telescoping motion of the second longitudinal tube section. One or more cables extend from the remote end of the innermost longitudinal tube section and traverse the top pulley assembly, the bottom pulley assembly and are fixed relative to the frame.

22 Claims, 10 Drawing Sheets

TELESCOPING TUBE ASSEMBLY WITH A CABLING SYSTEM

BACKGROUND OF THE INVENTION

The present invention relates to a telescoping tube assembly. In particular, the present invention relates to a telescoping tube assembly that includes a cabling system.

Telescoping tube assemblies such as disclosed in U.S. Pat. Nos. 5,465,854 and 6,026,970 are known. Generally, the telescoping tube assemblies disclosed in these patents include a first longitudinal tube section attached to a mounting platform and a second longitudinal tube section that telescopes relative to the first longitudinal tube section. Additional longitudinal tube sections can be disposed within the each other and within the second longitudinal tube section.

Generally, any cabling that is necessary for conducting a desired operation has been disposed on the exterior of the longitudinal tube sections. As the longitudinal tube sections extend and retract, the cabling has extended and retracted on the exterior along with the longitudinal tube sections.

In some applications, the telescoping tube assemblies are used to conduct underwater operations. A tool head with a cutting tool, for example, can be mounted on the remote end of the innermost longitudinal tube section. The longitudinal tube sections and cabling associated with the longitudinal tube sections extend into a water tank to carry out the desired operation.

The cutting tool, for example, can be used to cut metal in a radioactive water tank of a nuclear plant. Although the telescoping tube assemblies described above can be used to position the cutting tool within the tank, the existing cabling system is inadequate. In particular, the existing cabling system includes a cable housing with many crevices. The crevices can retain radioactive water as the tube assembly is retracted from the tank, which complicates decontamination. Inadequate decontamination can be hazardous due to contamination of other equipment and/or exposure of personnel to radioactivity.

The cabling that is necessary to traverse the longitudinal tube sections in the extended position can be quite long. When the telescoping assembly is in the retracted position, an undesirably large amount of cabling may be compressed into a small area that can lead to problems with tangling.

SUMMARY OF THE INVENTION

In a first aspect, the invention pertains to a telescoping tube assembly that includes a frame and a first longitudinal tube section mounted on the frame. A second longitudinal tube section is disposed within the first longitudinal tube section and adapted for telescoping motion into and out of the first longitudinal tube section. The telescoping tube assembly also includes a cabling system that includes a top pulley assembly and a bottom pulley assembly, the bottom pulley assembly adapted for movement in response to the telescoping motion of the second longitudinal tube section. One or more cables extend within the telescoping tube assembly from the remote end of the innermost longitudinal tube section and traverse the top pulley assembly, the bottom pulley assembly and are fixed relative to the frame.

In another aspect, the invention pertains to a telescoping assembly including a frame and a plurality of nested longitudinal tube sections wherein the outermost longitudinal tube section is fixed relative to the other, inner longitudinal tube sections. The telescoping tube assembly also includes a cabling system that includes a top pulley assembly and a bottom pulley assembly wherein the bottom pulley assembly is adapted for movement in response to the telescoping motion of the second longitudinal tube section. One or more cables extend within the telescoping tube assembly from the remote end of the innermost longitudinal tube section and traverse the top pulley, the bottom pulley and are fixed relative to the frame. A linear guide is attached to the frame and constrained to provide linear motion to the bottom pulley assembly in response to the telescoping motion of the longitudinal tube sections.

DETAILED DESCRIPTION OF THE PREFERRED EMBODIMENTS

The telescoping tube assembly of the present invention includes a telescoping tube mast and a cabling system. The cabling system includes a top pulley assembly and a bottom travelling pulley assembly that travels in response to the movement of movable longitudinal tube sections of the telescoping tube mast. The cabling can be disposed within the interior of the longitudinal tube sections to extend down the mast during extension and retraction of the tube sections. The cabling system operates in response to extension and retraction of the tube sections. In particular, the cabling system coils the cabling during retraction and uncoils during extension.

Figure 1:
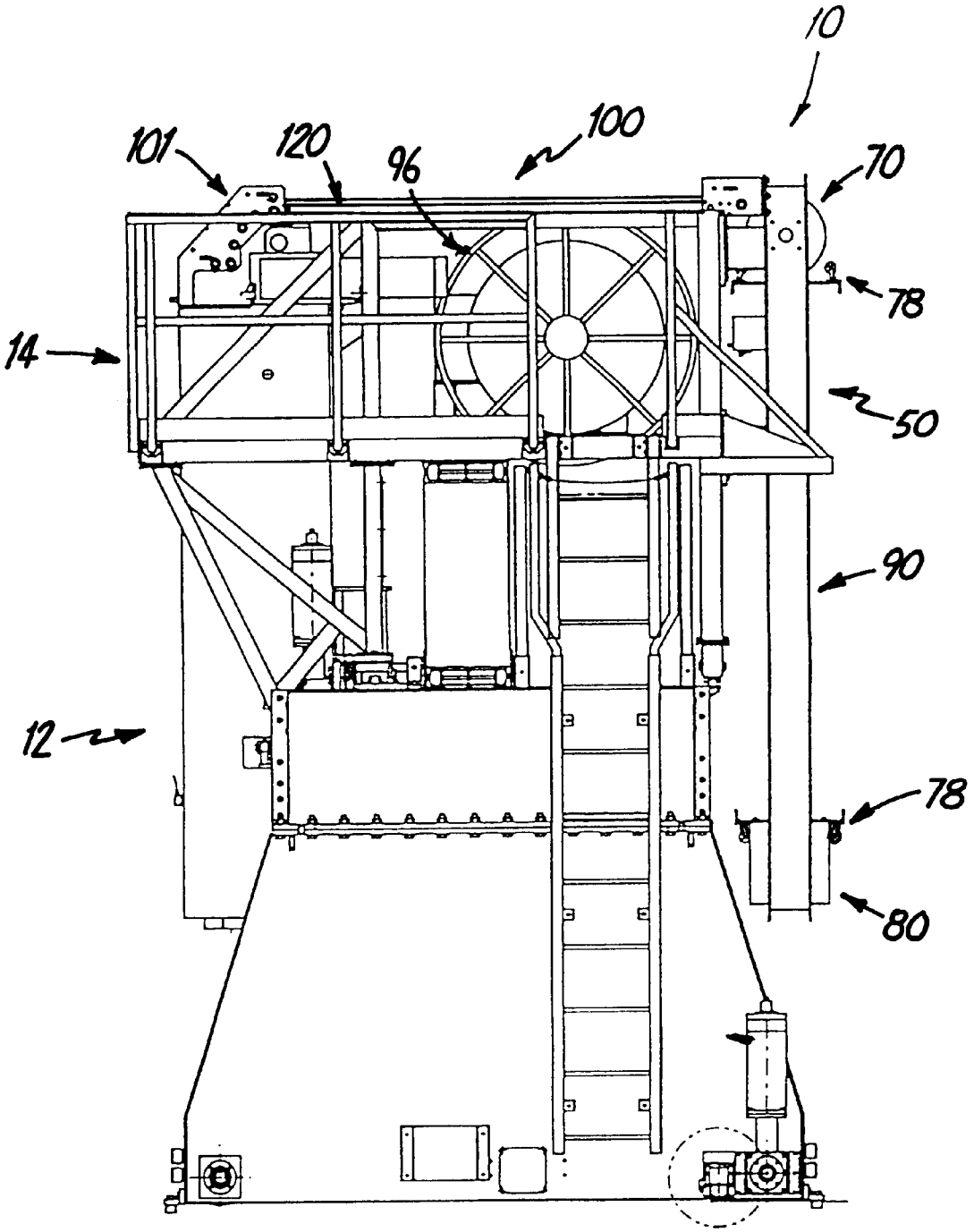
FIG. 1 is a side elevational view of a positioning assembly having a telescoping tube assembly of the present invention.
Figure 2:
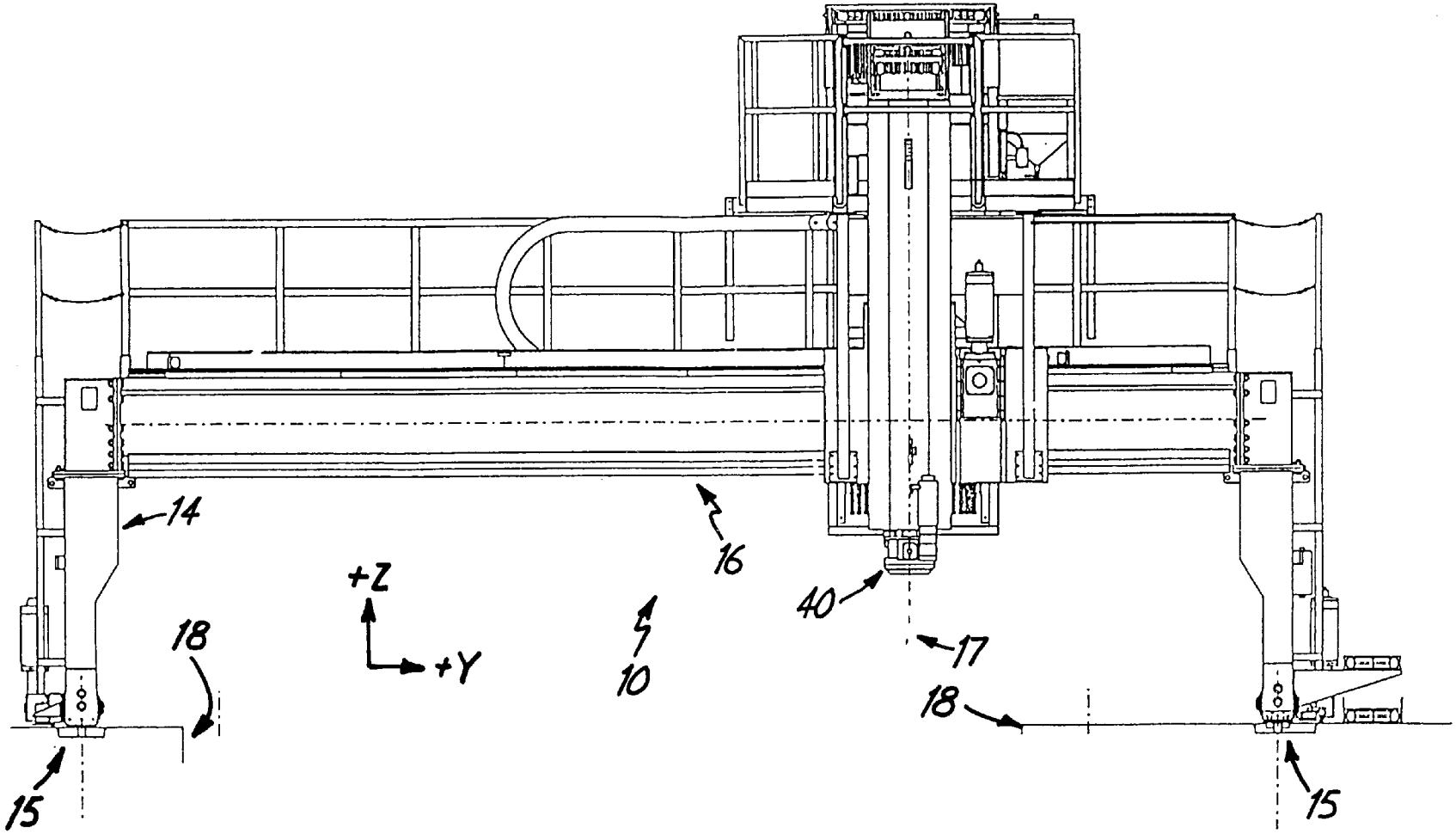
FIG. 2 is a front elevational view of the positioning assembly and the telescoping tube assembly.
Figure 3:
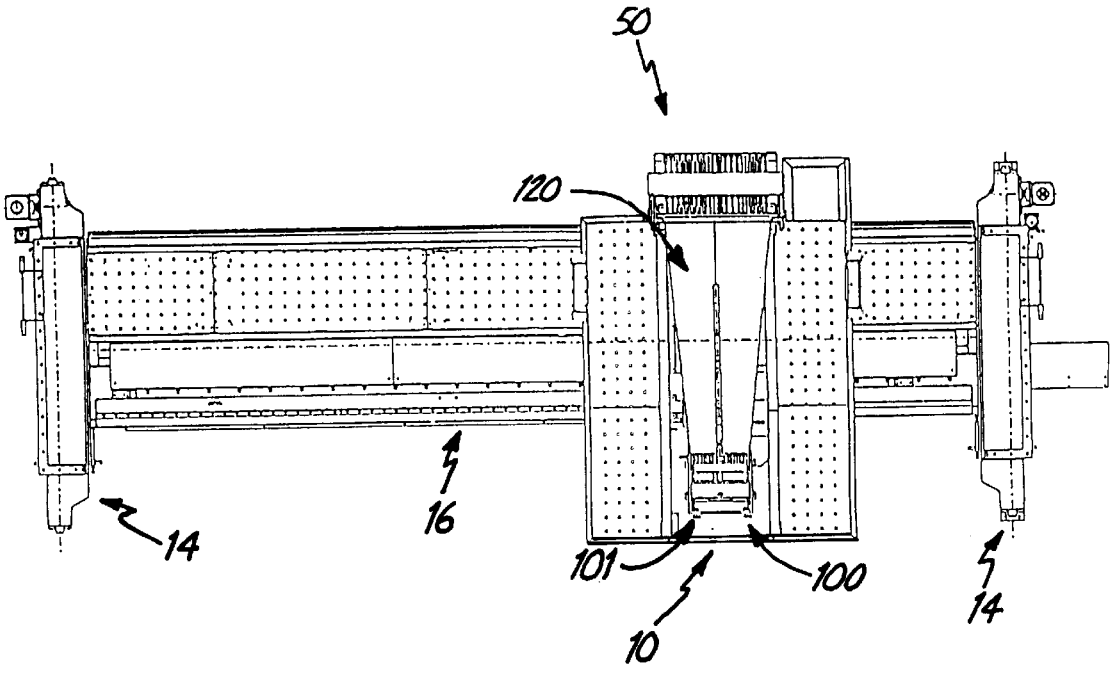
FIG. 3 is a top plan view of the positioning assembly and the telescoping tube assembly.

Illustrated generally in FIGS. 1–3 is a telescoping tube assembly 10 of the present invention. In the embodiment illustrated, the telescoping tube assembly 10 is attached to a positioning assembly 14 that selectively positions the telescoping tube assembly 10 in a two-dimensional plane. The positioning assembly 14 includes guide rails or channels 15 extending along parallel sides of the plane and a traversing frame member 16 extending between the guide rails 15. The telescoping tube assembly 10 is movable along the length of the frame member 16, while the frame member 16 is movable along the guide rails 15. In this manner, the telescoping tube assembly 10 can be positioned anywhere within the two dimensional plane. However, it should be noted that the positioning assembly 14 does not form part of the present invention, but rather is provided as an exemplary environment for the telescoping tube assembly 10. Those skilled in the art can appreciate that the telescoping tube assembly 10 can be used on other positioning assemblies or maintained in a stationary position.

The telescoping tube assembly 10 includes a telescoping tube mast 12 that extends and retracts in a longitudinally vertical direction from the positioning assembly 14 along a longitudinal axis 17. In the illustrated embodiment, a tool head 40 is mounted on the remote end of the telescoping tube assembly 10, while the positioning assembly 14 extends over a tank 18. The telescoping tube assembly 10 is used to submerge the tool head 40 within the tank 18 as discussed in the Background section above.

In the illustrated embodiment, the telescoping tube mast 12 comprises five longitudinal tube sections 20, 24, 28, 32 and 36. The outer-most longitudinal tube section 20 is mounted to the positioning assembly 14. Each of the succeeding sections 24, 28, 32 and 36 are moveable such that each section extends into and retracts from within the larger preceding section in a telescoping manner.

In the embodiment illustrated, the longitudinal tube sections 20, 24, 28, 32 and 36 and the means for allowing relative displacement are constructed in accordance with U.S. Pat. Nos. 5,465,854 and 6,026,970, which are incorporated herein by reference in their entirety.

Figure 4:
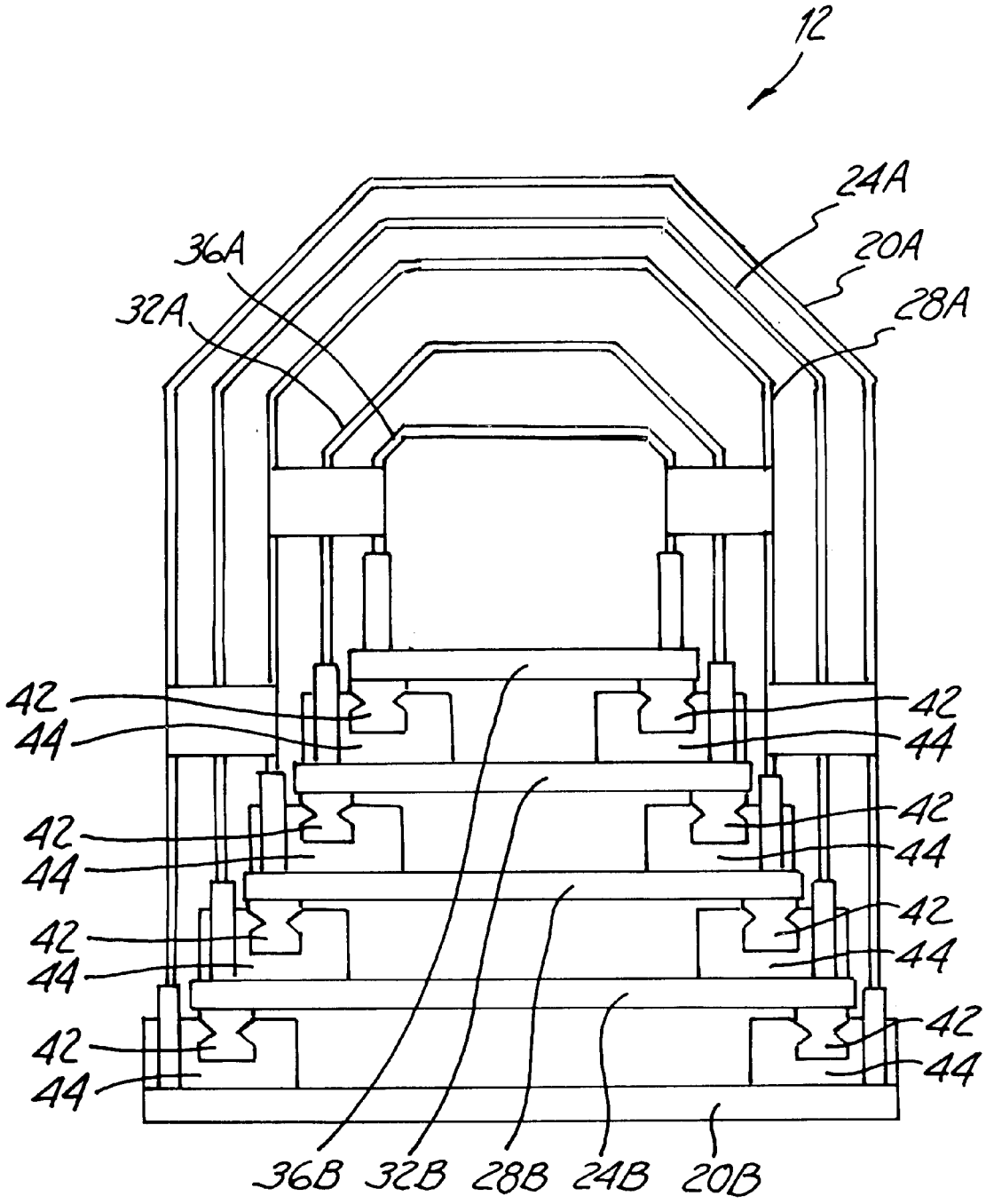
FIG. 4 is a schematic end view of a telescoping tube mast of the telescoping tube assembly.

Generally, as schematically shown in FIG. 4, each of the tube sections 20, 24, 28, 32 and 36 include a relatively thin "U" or similar shaped housing 20A, 24A, 28A, 32A and 36A joined to a thicker support plate 20B, 24B, 28B, 32B and 36B, respectively. The thicker support plates 20B, 24B, 28B, 32B and 36B although sufficiently rigid for compression and tension loading are inherently weak to torsion bending. The thin housings 20A, 24A, 28A, 32A and 36A provide a load path for shear loads in order to increase rigidity. When the longitudinal tube sections 20, 24, 28, 32 and 36 are fully extended, the tube sections overlap thereby allowing transfer of forces through the support plates 20B, 24B, 28B, 32B and 36B.

Referring to FIG. 4, two parallel linear bearing tracks 42 are joined to each of the support plates 24B, 28B, 32B and 36B. The linear bearing tracks 42 are attached on the opposite side of the support plates 24B, 28B, 32B and 36B as the housing 24A, 28A, 32A and 36A, while linear bearings 44 engage tracks 42 in a conventional manner to maintain the position of the support plates 20B, 24B, 28B, 32B and 36B and the tube sections 20, 24, 28, 32 and 36, relative to each other and parallel during extension and retraction. The linear bearings 44 are also joined to the support plates 20B, 24B, 28B and 32B.

It should be understood that the linear bearing tracks 42 and the linear bearings 44 are but one type of device to allow displacement of the tube sections 20, 24, 28, 32 and 36 relative to each other. As appreciated by those skilled in the art, other types of guiding devices such as rollers, wheels, slides, etc. can be used in place of or in addition to the linear bearing tracks 42 and linear bearings 44. Similarly, it is not necessary to limit use of the guiding devices to only between the support plates 20B, 24B, 28B, 32B and 36B. Rather, guiding devices can be arranged to engage the housings 20A, 24A, 28A, 32A and 36A, if desired. In addition, the present invention is not limited to telescoping tube sections comprising a thicker support plate and thin housings, but can also be incorporated into telescoping tube assemblies having longitudinal tube sections of other designs.

Figure 5:
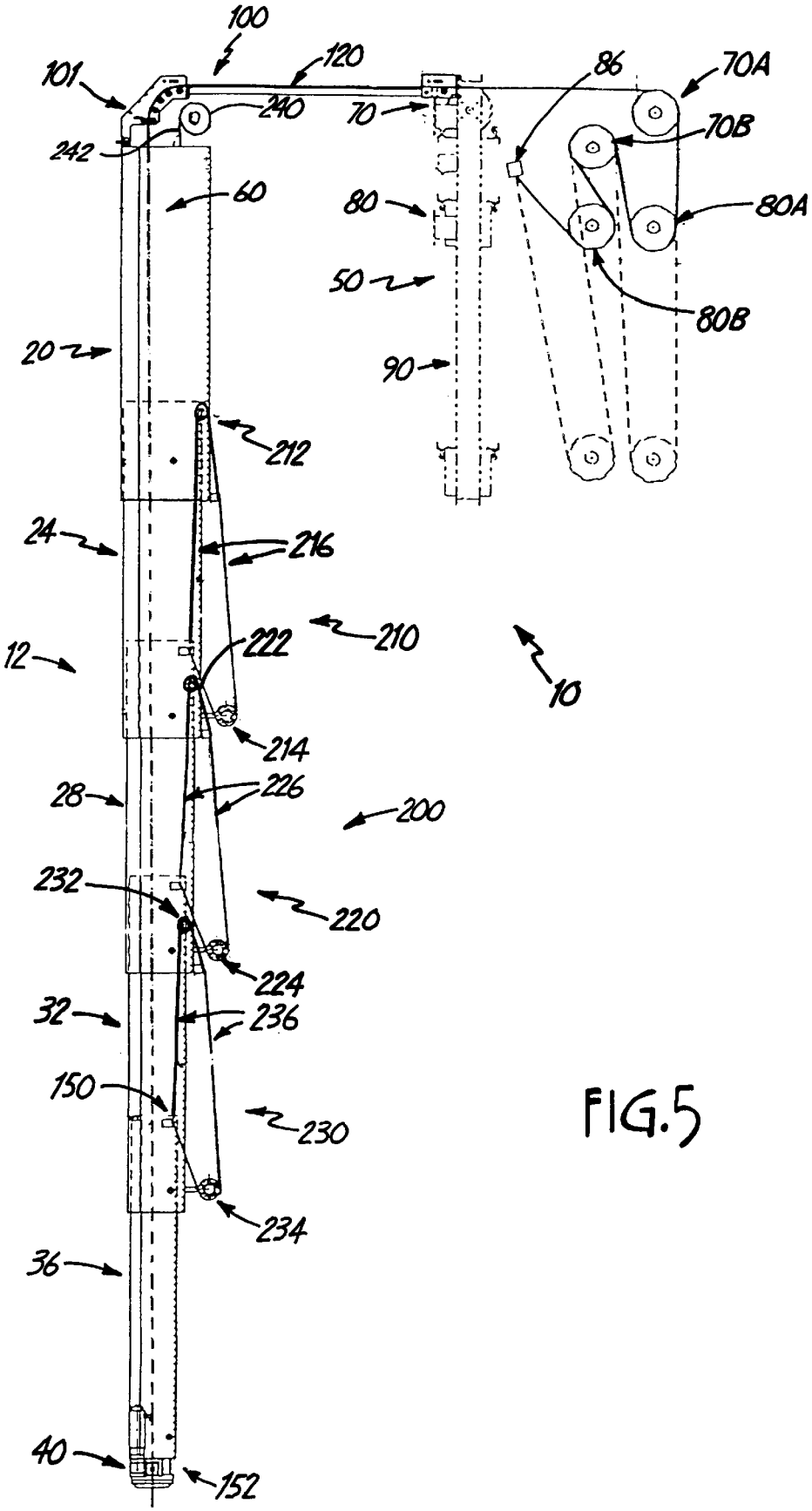
FIG. 5 is a schematic side view of the telescoping tube assembly.

One embodiment of the telescoping tube assembly 10 is schematically illustrated in FIG. 5. Cabling 60 extends from the remote end 152 of the innermost longitudinal section 36 to the proximate end of the fixed longitudinal tube section 20. Cabling 60 extends out of the longitudinal tube sections to a cabling system 50. Cabling 60 can include one or more cables. Generally, cabling 60 includes a plurality of cables. Cabling 60 as referred to herein includes, for example, electrical cables, load-bearing or lift cables, air hoses, water hoses and the like.

Figure 6A:
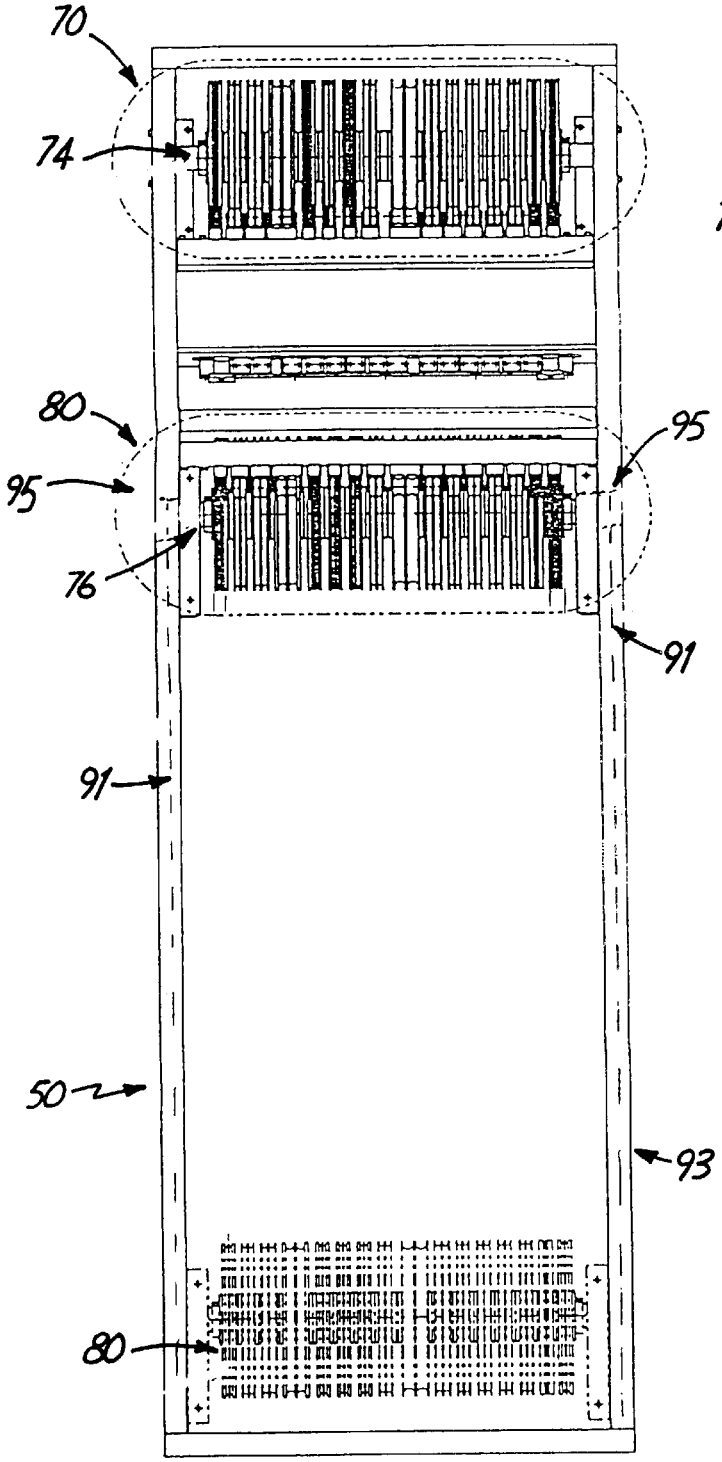
FIG. 6A is a front elevational view of a cabling system of the telescoping tube assembly with the cabling removed.
Figure 6B:
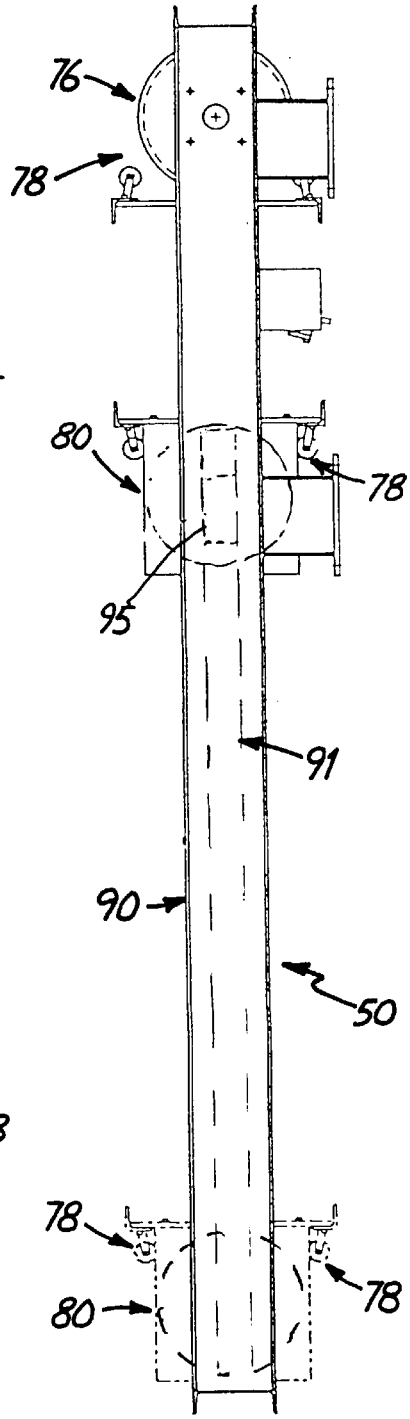
FIG. 6B is a side elevational view of the cabling system.

Referring also to FIG. 6A and FIG. 6B, shown with the cabling removed, the cabling system 50 includes a top pulley assembly 70 and a bottom pulley assembly 80 that moves relative to the top pulley assembly 70. Cabling 60 extends into the top pulley assembly 70 from the uppermost end of the longitudinal tube section 20. Cabling 60 generally traverses from the top pulley assembly 70 to the bottom pulley assembly 80 after which it may, optionally, be held fixed relative to the frame 44 at attachment point 86. The electrical conductors, hoses and the like forming the cabling 60 generally will continue past attachment point 86 to circuits and devices as appreciated by those skilled in the art.

The top pulley assembly 70 and the bottom pulley assembly 80 can comprise a number of pulleys and generally include an individual pulley for each of the cables of the cabling 60 such that each cable is individually guided. The individual pulleys are sized based on the size of the specific cable that is to be disposed on the pulley.

A cabling system 50 that includes one pulley in the top pulley assembly 70 and one pulley in the bottom pulley assembly 80 for each of the cables in cabling 60 may be sufficient in some embodiments. However, as illustrated in FIG. 5, the top pulley assembly 70 and the bottom pulley assembly 80 can include two top pulleys 70A and 70B and two bottom pulleys 80A and 80B for each of the cables of cabling 60. Additional top pulleys and bottom travelling pulleys for each of the cables are generally included as the length of the longitudinal tube sections increases and/or as the number of longitudinal tube sections increases. Additional pulleys accommodate longer lengths of cabling 60 that are necessary to traverse the increased length of the fully extended longitudinal tube sections.

In the embodiment illustrated, each cable of cabling 60 traverses, for example, from a top pulley 70A to bottom pulley 80A, from bottom pulley 80A to top pulley 70B and down to bottom pulley 80B. Cabling 60 may then be fixed at attachment point 86 after traversing bottom pulley 80B.

All of the pulleys of the top pulley assembly 70 are generally disposed on a single shaft 74. However, if desired, the pulleys may be disposed on multiple shafts. Similarly, the pulleys of bottom pulley assembly 80 may be disposed on a single shaft 76, or alternatively, on multiple shafts.

Referring to FIG. 6A and FIG. 6B, with the cabling removed, where all of the pulleys of the top pulley assembly 70 are disposed on shaft 74 and all of the pulleys of the bottom pulley assembly 80 are disposed on shaft 76, each of the cables in cabling 60 is allotted two top pulleys and two bottom pulleys on the shafts 74 and 76. When cabling 60 includes 10 cables, for example, there can be 20 top pulleys on shaft 74 and 20 bottom pulleys on shaft 76.

When the longitudinal tube sections are in the fully extended positions as shown in FIG. 5, the bottom travelling pulley assembly 80 is in the "up" position, i.e. closest to the top pulley assembly 70. As the longitudinal sections retract, the bottom pulley assembly 80 moves downward relative to the top pulley assembly 70. When the longitudinal tube sections are fully retracted, the bottom pulley assembly 80 will be in the "down" position relative to the top pulley assembly 70, i.e. farthest distance from the top pulleys, as shown schematically in dashed lines in FIGS. 5 and 6A. When the longitudinal tube sections again extend, the bottom pulley assembly 80 moves linearly upward toward the top pulley assembly 70. During longitudinal tube section retraction, the increase in distance between the top pulley assembly 70 and bottom pulley assembly 80 can accommodate the increasing length of cabling that extends out of the longitudinal tube sections. The position of the bottom pulley assembly 80, thus, is determined by the degree of extension/retraction of the longitudinal tube sections 24, 28, 32 and 36.

In the illustrated embodiment in which each cable has two corresponding two top pulleys and two bottom pulleys, the bottom pulleys will be displaced about one quarter of the distance relative to the total displacement of the longitudinal tube sections. In other words, if the longitudinal tube sections retract a total of about 40 inches, the bottom pulleys will move down about 10 inches. The bottom pulley assembly 80 can be positioned at the "up" position, the "down" position or anywhere in between the "up" and the "down" position. It will be appreciated that the cabling system 50 is a passive system wherein the bottom pulley assembly 80 moves due to the force of gravity, maintaining tautness of individual cables. If desired, springs or other mechanisms can be used to displace the bottom pulley assembly 80 in addition or in the alternative to the use of gravity.

In the embodiment illustrated, the cabling system 50 includes a linear guide 90 attached to a frame 93. The linear guide 90 constrains the bottom pulley assembly 80 to provide linear motion to the bottom pulley assembly 80 in response to the telescoping motion of the longitudinal tube sections. In one embodiment, the linear guide 90 is a linear bearing system having opposed rails 91 provided on each side of frame 93. Shaft 76 is supported on slide elements 95, which engage and slide along guide rails 91. However, it should be understood that other guides such as channels, wheels, rollers and the like may also be used.

The cabling system 50 may also include one or more guide rollers or pulleys 78 as shown in FIG. 6B. Guide pulleys 78 are positioned to restrain the cables on the pulleys of the top pulley assembly 70 and the bottom pulley assembly 80. The pulleys 78 may be positioned at one or more sites around the circumference of the pulleys of the top pulley assembly 70 and the bottom pulley assembly 80. The pulleys 78 at any particular location can be on a single shaft or on multiple shafts. Furthermore, individual pulleys can be used for each cable or joined together as desired. It should be understood that the use of pulleys or rollers is but one embodiment for restraining the cables on the appropriate pulleys. Other mechanisms for restraining cables on the appropriate pulleys may be used.

At this point, it should be noted that the telescoping tube assembly 10 may include other cables, spools and pulleys not forming part of cabling system 50. For example, a large spool 96 is provided for a large diameter hose that extends down into mast 12. The hose provides cutting material to the cutting head. The hose is provided from spool 96 because the hose is less flexible and can not be coiled as tight as the cabling 60 handled by the cabling system 50.

Figure 7:
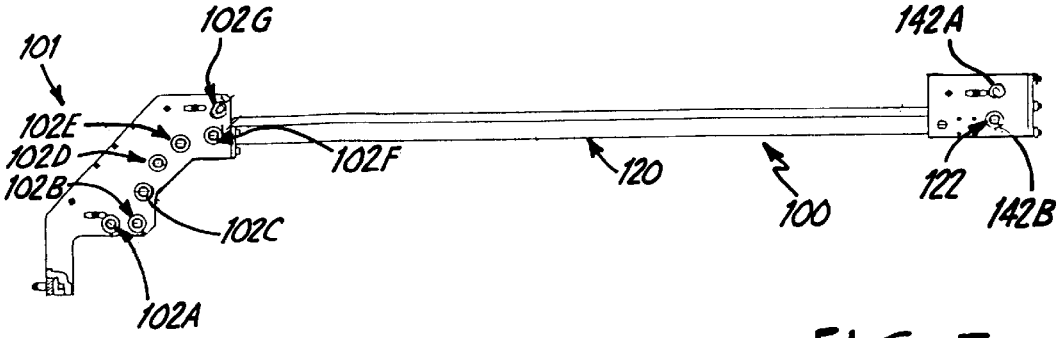
FIG. 7 is a side elevational view of a cable guiding assembly.
Figure 8:
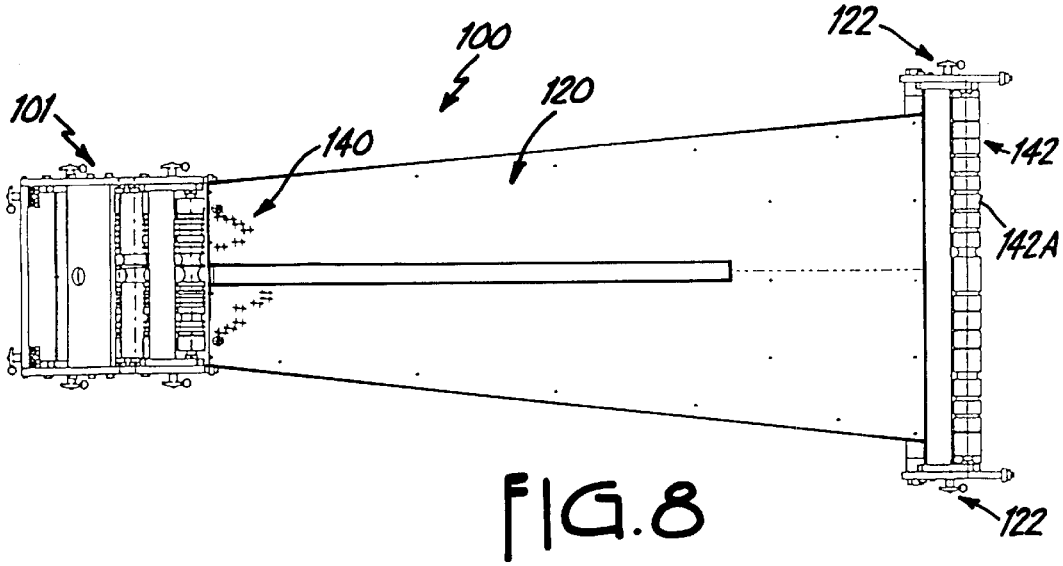
FIG. 8 is a top plan view of the cable guiding assembly.
Figure 9B:
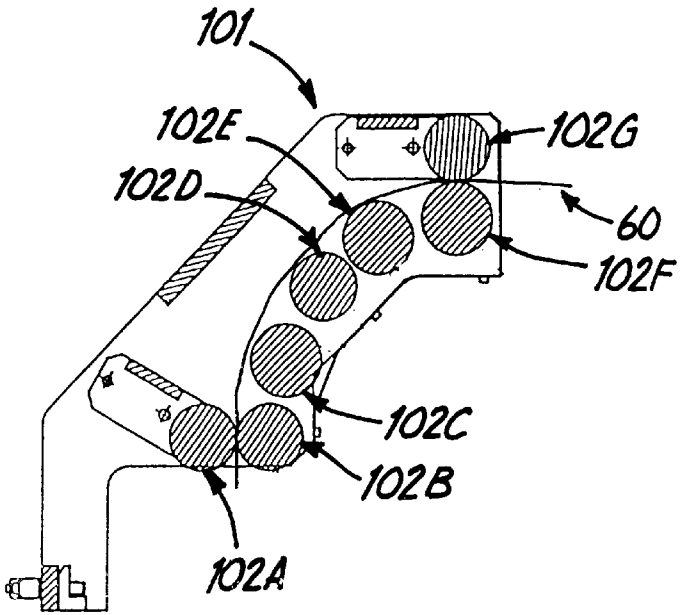
FIG. 9B is a sectional view of the guiding pulley system taken along lines 9B—9B of FIG. 9A.
Figure 9A:
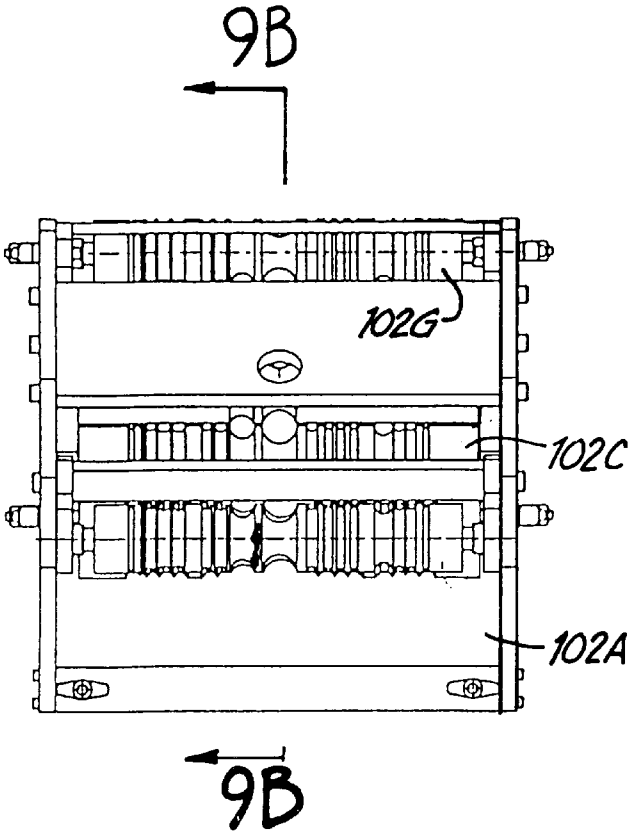
FIG. 9A is a front elevational view of a guiding pulley system.

The telescoping tube assembly 10 may also include a cable guiding assembly 100 extending from the mast 12 to cabling system 50. One embodiment of a cable guiding assembly 100 is illustrated in FIGS. 7 and 8. In the embodiment illustrated, the cable guiding assembly 100 includes a guiding pulley system 101. Referring also to FIG. 9A and 9B, guiding pulley system 101 includes a series of guide pulleys 102A, 102B, 102C, 102D, 102E, 102F, and 102G that are adapted to receive cabling 60 from the interior of the longitudinal tube sections. The cabling 60 traverses guiding pulley system 101 and extends to the top pulley assembly 70.

As illustrated in FIG. 9B, guide pulleys 102A, 102B, 102C, 102D, 102E, 102F and 102G are positioned to form an arc to guide the cabling 60 extending from the uppermost end of telescoping tubes, over and toward the top pulley assembly 70. The guide pulleys 102A and 102G are positioned to retain the cabling in guide pulley 102B and guide pulley 102F, respectively. Each of the guide pulleys 102A–102G include an individual pulley for each cable of cabling 60 as shown in FIG. 9A. Generally, the individual pulleys of a guide pulley are disposed on a single shaft. Guide pulley 102A, for example, has a number of individual pulleys, corresponding to the number of cables in cabling 60, disposed on a single shaft. It will be understood that other guiding pulley systems can also be used.

In the embodiment illustrated in FIGS. 7–8, the cable guiding assembly 100 includes a pivotable tray 120 disposed between the guiding pulley system 101 and top pulley assembly 70. The pivotable tray 120 includes a pivot axis 122. The pivot axis 122 is generally positioned in cable guiding system 100 at the end proximal to top pulley assembly 70. The pivotability of tray 120 can be advantageous for accessing the cabling within the longitudinal tube sections 20, 24, 28, 32 and 36 as it allows guiding pulley system 101 to be lifted upward and away from tube section 20. Cables of cabling 60 traverse on top of tray 120 between guiding pulley system 101 and top pulley assembly 70.

The cable guiding assembly 100 may also include cable guides disposed on or proximal to the guiding pulley system 101 and the top pulley assembly 70. In the embodiment illustrated in FIG. 8, cable guiding assembly 100 includes cable guides 140 and 142. The cable guides 140 and 142 are adapted to receive each of the individual cables of the cabling 60 and to direct the cable in a desired manner. In FIG. 8, cable guide 140 is proximate to the guiding pulley system 101 and cable guide 142 is proximate to top pulley assembly 70.

Referring to FIG. 8, the width of pivotable tray 120 proximate to guiding pulley system 101 is less than the width proximate to top pulley assembly 70, i.e. the width of tray 120 increases from guiding pulley system 101 to top pulley assembly 70. The increase in width occurs because each of the guide pulleys of guiding pulley system 101 has one individual pulley for each cable in the cabling 60. However, in top pulley assembly 70 each cable has two corresponding individual pulleys. Insertion of the cables into guiding pulley system 101 and/or top pulley assembly 70, thus, may occur at an angle. The cable guides 140 and 142 are generally adapted for reducing the angle of cable insertion into guiding pulley system 101 and/or into top pulley assembly 70. In other words, the cable guides 140 and 142 align each of the cables with the corresponding pulleys so as to ensure that the cables do not run off the pulleys during operation.

It will also be appreciated that the cables disposed at the edges of the pivotable tray 120 i.e. cables closest to the side edges of the pivotable tray 120, can require the greatest change in direction by cable guide 140 and/or cable guide 142. The smaller and lighter cables, thus, are generally positioned closest to the side edges of the pivotable tray 120, guiding pulley system 101, top pulley assembly 70, cable guide 140 and cable guide 142. In contrast, the larger and heavier cables are positioned toward the middle of the pivotable tray 120, guiding pulley system 101, top pulley assembly 70, cable guide 140 and cable guide 142. The cable 88 on the outermost pulley on each side of the bottom pulley assembly 80 is generally a load-bearing wire rope that pulls shaft 76 up and down. In the illustrated embodiment, the wire rope is about ¼ inch in diameter.

The cable guide 140 can include a separator structure (spaced apart fingers) with one or more grooves, wherein each groove receives one of the cables of cabling 60. The grooves, preferably, have appropriate depth such that the cables are retained within the groove. Each cable that is spanning from top pulley assembly 70 to guiding pulley system 101 may traverse through a groove of the cable guide 140. The path of the cables between guiding pulley system 101 and the cable guide 140 is, preferably, straight.

Cable guide 140 and cable guide 142 may be made from a variety of materials, preferably materials with low friction characteristics to minimize the wear on cables. Suitable materials include, for example, Teflon™, Turcite™ and the like.

The cable guide 142 can be a series counter rotating pulleys relative to top pulley assembly 70. The counter rotating pulleys are positioned to guide the cables to the appropriate individual top pulley in top pulley assembly 70. The counter rotating pulleys are generally formed from a first rotating pulley 142A and a second rotating pulley 142B that define an enclosed space through which a cable can travel and be retained within (similar to 102F and 102G).

It will be appreciated that both cable guide 140 and cable guide 142 guide the cables into guiding pulley system 101 and top pulley assembly 70, respectively, at more desirable angles. The specific cable guide structure for each of cable guides 140 and 142 can vary. Cable guide 142 may include, for example, a separator structure with grooves and cable guide 140 may include counter rotating pulleys. Furthermore, other types of cable guides that can alter the path of the cables may be used.

Cabling 60 may be clamped using clamping assembly 150 on the proximal end of the innermost longitudinal tube section 36 as shown in FIG. 5. In the illustrated embodiment, clamping assembly 150 includes plates having apertures for each of the cables of cabling 60. Each of the cables is clamped in the apertures of clamping assembly 150. Clamping assembly 150 can also prevent tangling of the cables. It should be understood that other clamping assemblies may be used.

The cables in the cabling, clamped at the proximal end of the innermost longitudinal tube section 36, may extend down to a remote end 152 of the innermost longitudinal tube section 36.

Figure 10:
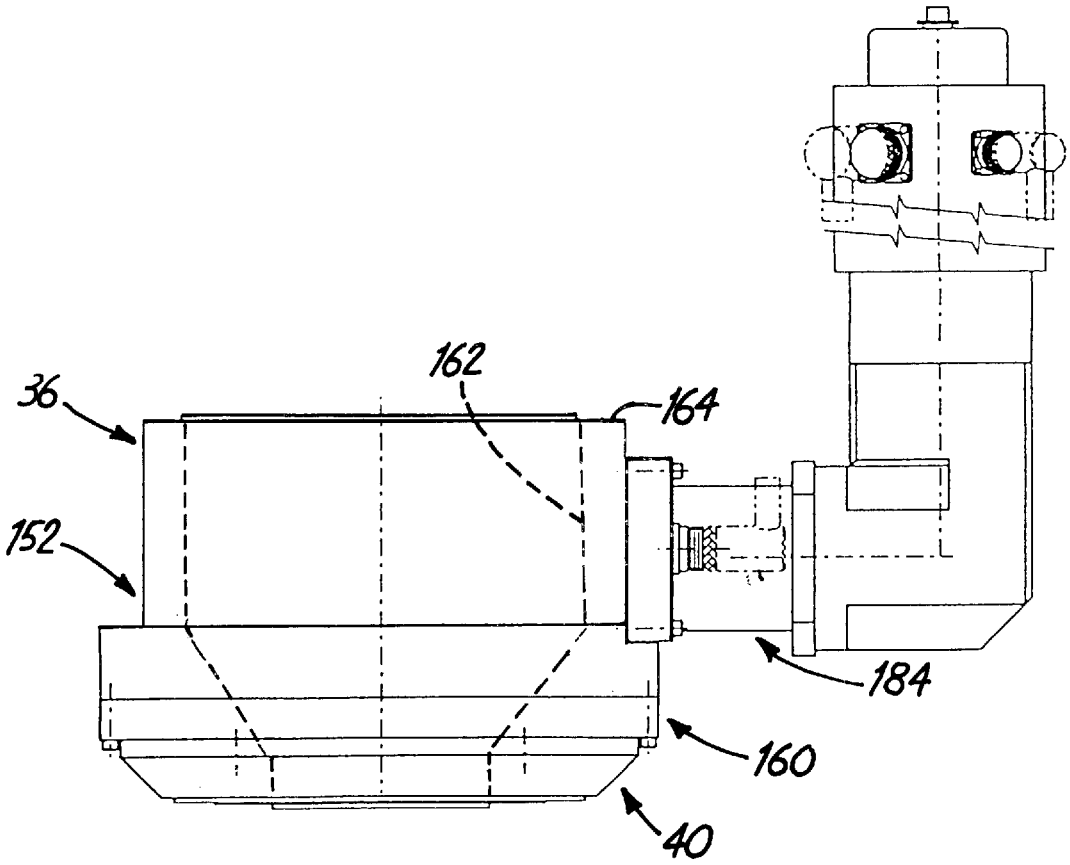
FIG. 10 is a front elevational view of a wrist assembly.

In the embodiment illustrated, a wrist assembly 160 is attached at the remote end 152 of the innermost longitudinal tube section 36 as shown in FIG. 10. Wrist assembly 160 includes a hollow center 162 that is fitted with a hollow pipe 164 as shown in FIG. 11.

Figure 11:
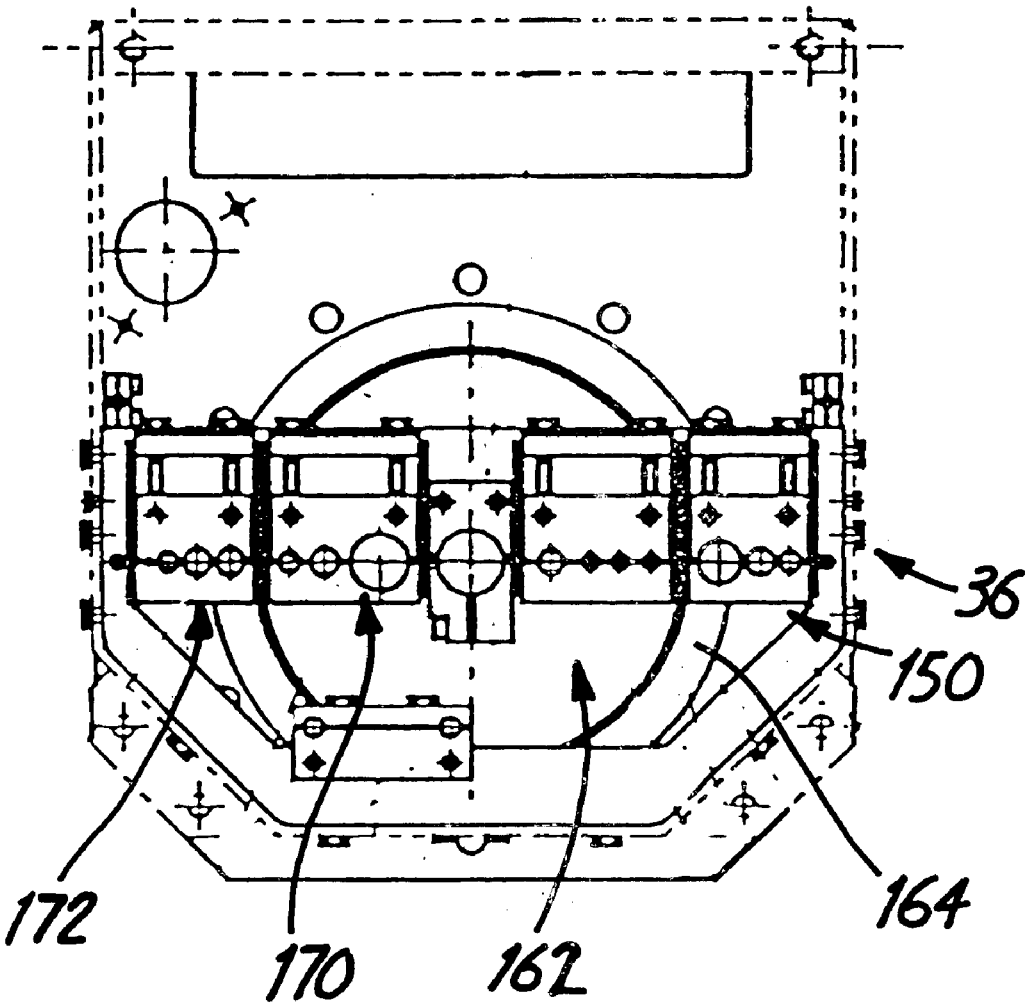
FIG. 11 is a top view of a clamping assembly at a proximal end of the innermost longitudinal tube section.

Cabling 60 may be separated into two groups of cables, interior cables 170 and exterior cables 172 as shown in FIG. 11. Interior cables 170 can be disposed in the interior of the hollow pipe 164 of wrist assembly 160. Exterior cables 172 can be disposed on the exterior of the wrist assembly 160. The interior cables 170 may be twisted while exterior cables 172 generally are not twisted during operation of a tool head 40. Separation of the interior cables 170 and exterior cables 172, thus, reduces the tangling of the cables during operation of a tool head.

Referring to FIG. 5 and FIG. 10, a tool head 40 may be rotatably attached to the wrist assembly 160 for performing desired operations. As is known in the art, tool heads can include cutting implements, drilling implements and the like for conducting the desired tasks. The tool head 40 may be rotatable, for example, for about ±225°. There generally is a drive 184 for operating tool head 40. The drive 184 may be, for example, a worm gear, a conventional mechanism in the art.

Interior cables 170 are clamped at proximal end 150 with allowance for rotation of the interior cables 170 in response to the rotation of tool head. The position is chosen so as not to exceed twist ratings of the cables. Exterior cables 172 generally are not rotated during operation of the tool head 180 and thus, allowance for twisting of the exterior cables may not be included. It will be understood that any of the cables in the cabling 60 can be accommodated to be twistable or nontwistable depending on the function of the cable.

The telescoping tube assembly may also include a waterjet system for rinsing the longitudinal tube sections and/or the cabling 60. The waterjet system can be disposed at the uppermost end of the telescoping tube mast. The waterjet system can include a showerhead and appropriate connections to a water source. When desired, the waterjet system can be turned on to send water into the interior of the longitudinal tube sections. This can rinse the cabling 60 and interior faces of the longitudinal tube sections. Rinsing of cabling 60 may be desirable if, for example, tank 18 includes water contaminated with radioactivity.

In the illustrated embodiment, the telescoping tube assembly includes lift assembly 200 that includes reeving cables. Lift assembly 200 allows for equal incremental retraction and extension of the longitudinal tube sections 24, 28, 32 and 36. Lift assembly 200 includes sublift assemblies 210, 220 and 230. It should be understood that the lift assembly 200 is schematically illustrated in FIG. 5 wherein subassemblies 210, 220 and 230 may be incorporated inside of the mast 12.

Sublift assembly 210 includes pulley 212 and pulley 214 attached to the proximate and remote ends of longitudinal tube section 24, respectively. Reeving cable 216 is disposed on pulley 212 and pulley 214. Reeving cable 216 is attached to the remote end of longitudinal tube section 20 and the proximate end of longitudinal tube section 28.

Sublift assembly 220 includes pulley 222 and pulley 224 attached to the proximate and remote end of longitudinal tube section 28, respectively. Reeving cable 226 is disposed on pulley 222 and pulley 224. Reeving cable 226 is attached to the remote end of longitudinal tube section 24 and the proximate end of longitudinal tube section 32.

Sublift assembly 230 includes pulley 232 and pulley 234 attached to the proximate and remote end of longitudinal tube section 32, respectively. Reeving cable 236 is disposed on pulley 232 and pulley 234. Reeving cable 236 is attached to the remote end of longitudinal tube section 28 and the proximate end of longitudinal tube section 36.

In the illustrated embodiment, a hoist drum (schematically illustrated in FIG. 5 at 240) and lifting cable 242 are provided. The lifting cable 242 is connected to end 152. When end 152 is lifted, sublift assemblies 210, 220 and 230 provide telescoping motion of mast 12.

However, it will be understood that other lift assemblies may also be used to accomplish equal incremental retraction and extension of the longitudinal tube sections 24, 28, 32 and 36. Other suitable lift assemblies are described, for example, in U.S. Pat. Nos. 5,465,854 and 6,026,970, which are incorporated herein by reference in their entirety.

Although the present invention has been described with reference to preferred embodiments, workers skilled in the art will recognize that changes may be made in form and detail without departing from the spirit and scope of the invention.

What is claimed is:

1. A telescoping tube assembly comprising:

a frame;

a first longitudinal tube section mounted on the frame;

an innermost longitudinal tube section disposed within the first longitudinal tube section and adapted for telescoping motion into and out of the first longitudinal tube section, wherein the innermost longitudinal tube section comprises a remote end;

a cabling system comprising a top pulley assembly and a bottom pulley assembly, the bottom pulley assembly adapted for movement relative to the top pulley assembly and in response to the telescoping motion of the innermost longitudinal tube section wherein the top pulley assembly is stationary relative to the first longitudinal tube section;

one or more cables extending within the telescoping tube sections from the remote end of the innermost longitudinal tube section and traversing the top pulley assembly and the bottom pulley assembly, wherein the top pulley assembly is traversed before the bottom pulley assembly, the one or more cables being fixed relative to the frame.

2. The telescoping tube assembly of claim 1 further comprising:

a second longitudinal tube section disposed within the first longitudinal tube section and adapted for telescoping motion into and out of the first longitudinal tube section;

a third longitudinal tube section disposed within the second longitudinal tube section and adapted for telescoping motion into and out of the second longitudinal tube section;

a fourth longitudinal tube section disposed within the third longitudinal tube section and adapted for telescoping motion into and out of the third longitudinal tube section; and the innermost longitudinal tube section disposed within the fourth longitudinal tube section and adapted for telescoping motion into and out of the fourth longitudinal tube section.

3. The telescoping tube assembly of claim 2 wherein the top pulley assembly comprises one pair of pulleys for each of the cables and the bottom pulley assembly comprises a pair of pulleys for each of the cables, wherein each cable from the remote end repeatedly traverses the top pulley assembly and bottom pulley assembly beginning with the top pulley assembly.

4. The telescoping tube assembly of claim 3 wherein the bottom pulley assembly moves closer to the top pulley assembly as the longitudinal tube sections extend.

5. The telescoping tube assembly of claim 3 further comprising:

a linear guide attached to the frame and constrained to provide linear motion to the bottom pulley assembly in response to the telescoping motion of the longitudinal sections.

6. The telescoping tube assembly of claim 5 wherein the linear guide is a linear bearing system.

7. The telescoping tube assembly of claim 3 further comprising a cable guiding assembly disposed between the longitudinal tube sections and the cabling system, the cable guiding assembly comprising a guiding pulley system adapted to receive the one or more cables from the longitudinal tube sections and to guide the cables into the top pulley assembly.

8. The telescoping tube assembly of claim 7 wherein the cable guiding assembly further comprises a cable guide proximate to the guiding pulley system.

9. The telescoping tube assembly of claim 8 wherein the cable guide comprises a separator structure with one or more grooves.

10. The telescoping tube assembly of claim 7 wherein the cable guiding assembly further comprises a cable guide proximate to the top pulley assembly.

11. The telescoping tube assembly of claim 10 wherein the cable guide comprises counter rotating pulleys.

12. The telescoping assembly of claim 3 wherein one or more of the cables are clamped at the proximal end of the innermost longitudinal tube section.

13. The telescoping assembly of claim 1 wherein the cable guiding assembly further comprises a pivotable tray disposed between the top end of the first longitudinal tube section and the top pulley assembly, the tray having a pivot point proximate to the top pulley assembly.

14. The telescoping assembly of claim 1 further comprising a wrist assembly having a hollow center and mounted at the remote end of the innermost longitudinal tube section wherein one or more cables extends through the hollow center.

15. The telescoping tube assembly of claim 14 wherein the one or more cables disposed in the hollow center are twistable.

16. The telescoping tube assembly of claim 1 further comprising:

a lift assembly for extending and retracting the innermost longitudinal tube section.

17. A telescoping assembly comprising:

a frame;

a plurality of nested longitudinal tube sections comprising an outermost longitudinal tube section and an innermost longitudinal tube section having a remote end, wherein the outermost longitudinal tube section is fixed relative to the frame;

a cabling system comprising a top pulley assembly having a top pulley and a bottom pulley assembly having a bottom pulley, the bottom pulley assembly adapted for movement relative to the top pulley assembly and in response to the telescoping motion of the innermost longitudinal tube section wherein the top pulley assembly is stationary relative to the outermost longitudinal tube section;

one or more cables extending within the plurality of nested longitudinal tube sections from the remote end of the innermost longitudinal tube section and traversing the top pulley assembly and the bottom pulley assembly, wherein the top pulley assembly is traversed before the bottom pulley assembly for each cable, the one or more cables being fixed relative to the frame; and a linear guide attached to the frame and constrained to provide linear motion to the bottom pulley assembly in response to the telescoping motion of the longitudinal tube sections.

18. The telescoping tube assembly of claim 17 wherein the linear guide is a linear bearing system.

19. The telescoping tube assembly of claim 17 wherein the top pulley assembly further comprises a second top pulley for each of the cables and the bottom pulley assembly further comprises a second bottom pulley adjacent to the first-mentioned bottom pulley for each of the cables, wherein the cable first-mentioned traverses the first-mentioned top pulley, then the first-mentioned bottom pulley, then the second top pulley, and last the second bottom pulley.

20. The telescoping tube assembly of claim 19 further comprising a guiding pulley system adapted to receive the one or more cables from the longitudinal tube sections and to guide the cables into the top pulley assembly.

21. The telescoping tube assembly of claim 20 further comprising a cable guide proximate to the guiding pulley system.

22. The telescoping tube assembly of claim 20 further comprising a cable guide proximate to the top pulley assembly.

* * * * *

UNITED STATES PATENT AND TRADEMARK OFFICE

CERTIFICATE OF CORRECTION

PATENT NO. : 6,561,368 B1
DATED : May 13, 2003
INVENTOR(S) : Sturm, Jr. et al.

It is certified that error appears in the above-identified patent and that said Letters Patent is hereby corrected as shown below:

Title page,
Item [56], References Cited, please add the following U.S. references:

-- U.S. PATENT DOCUMENTS

| | | | |
|---|---|---|---|
| 5,478,192 | 12/1995 | Bentivoglio | 414/918 |
| 5,401,134 | 3/1995 | Habicht et al. | 187/413 |
| 4,691,806 | 9/1987 | Jansen et al. | 187/413 -- |

Signed and Sealed this

Eighteenth Day of November, 2003

JAMES E. ROGAN
*Director of the United States Patent and Trademark Office*